US009091970B2

(12) United States Patent
Shigezaki et al.

(10) Patent No.: US 9,091,970 B2
(45) Date of Patent: Jul. 28, 2015

(54) TRANSFER DEVICE, IMAGE FORMING APPARATUS, AND TRANSFER METHOD

(71) Applicant: FUJI XEROX CO., LTD., Tokyo (JP)

(72) Inventors: Satoshi Shigezaki, Kanagawa (JP); Sho Watanabe, Kanagawa (JP); Tomoaki Yoshioka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/219,674

(22) Filed: Mar. 19, 2014

(65) Prior Publication Data

US 2015/0016851 A1 Jan. 15, 2015

(30) Foreign Application Priority Data

Jul. 11, 2013 (JP) ..... 2013-145797

(51) Int. Cl.
*G03G 15/16* (2006.01)

(52) U.S. Cl.
CPC ..... *G03G 15/1675* (2013.01); *G03G 15/1605* (2013.01); *G03G 2215/0129* (2013.01)

(58) Field of Classification Search
CPC ..... G03G 15/1675
USPC ..... 399/66, 314
See application file for complete search history.

(56) References Cited

U.S. PATENT DOCUMENTS

2004/0037573 A1* 2/2004 Hirota et al. ..... 399/12
2013/0148993 A1* 6/2013 Aoki et al. ..... 399/66

FOREIGN PATENT DOCUMENTS

JP A-2006-267486 10/2006
JP A-2006-317633 11/2006
JP 2011-203548 A 10/2011
JP 2013-125053 A 6/2013

OTHER PUBLICATIONS

Oct. 8, 2014 Office Action issued in Japanese Patent Application No. 2013-145797.

* cited by examiner

*Primary Examiner* — Benjamin Schmitt
(74) *Attorney, Agent, or Firm* — Oliff PLC

(57) ABSTRACT

A transfer device includes a transfer portion that transfers a toner image formed with a toner containing flat pigment particles to a recording medium; a DC voltage applying portion that applies a DC voltage to the transfer portion; and an AC voltage applying portion that applies an AC voltage to the transfer portion.

6 Claims, 10 Drawing Sheets

TRANSFER DEVICE, IMAGE FORMING APPARATUS, AND TRANSFER METHOD

CROSS-REFERENCE TO RELATED APPLICATIONS

This application is based on and claims priority under 35 USC 119 iron; Japanese Patent Application No. 2013-145797 filed Jul. 11, 2013.

BACKGROUND

1. Technical Field

The present invention relates to a transfer device, an image forming apparatus, and a transfer method.

2. Summary

According to an aspect of the invention, there is provided a transfer device including a transfer portion that transfers a toner image formed, with a toner containing flat pigment particles to a recording medium; a DC voltage applying portion that applies a DC voltage to the transfer portion; and an AC voltage applying portion that applies an AC voltage to the transfer portion.

With the transfer device according to the first aspect of the present invention, it is possible to make the orientation of flat pigment particles irregular, compared with a case where only a DC voltage is applied to a transfer portion.

BRIEF DESCRIPTION OF THE DRAWINGS

Exemplary embodiments of the present invention will be described in detail based on the following figures, wherein.

DETAILED DESCRIPTION

First Exemplary Embodiment

Figure 6:
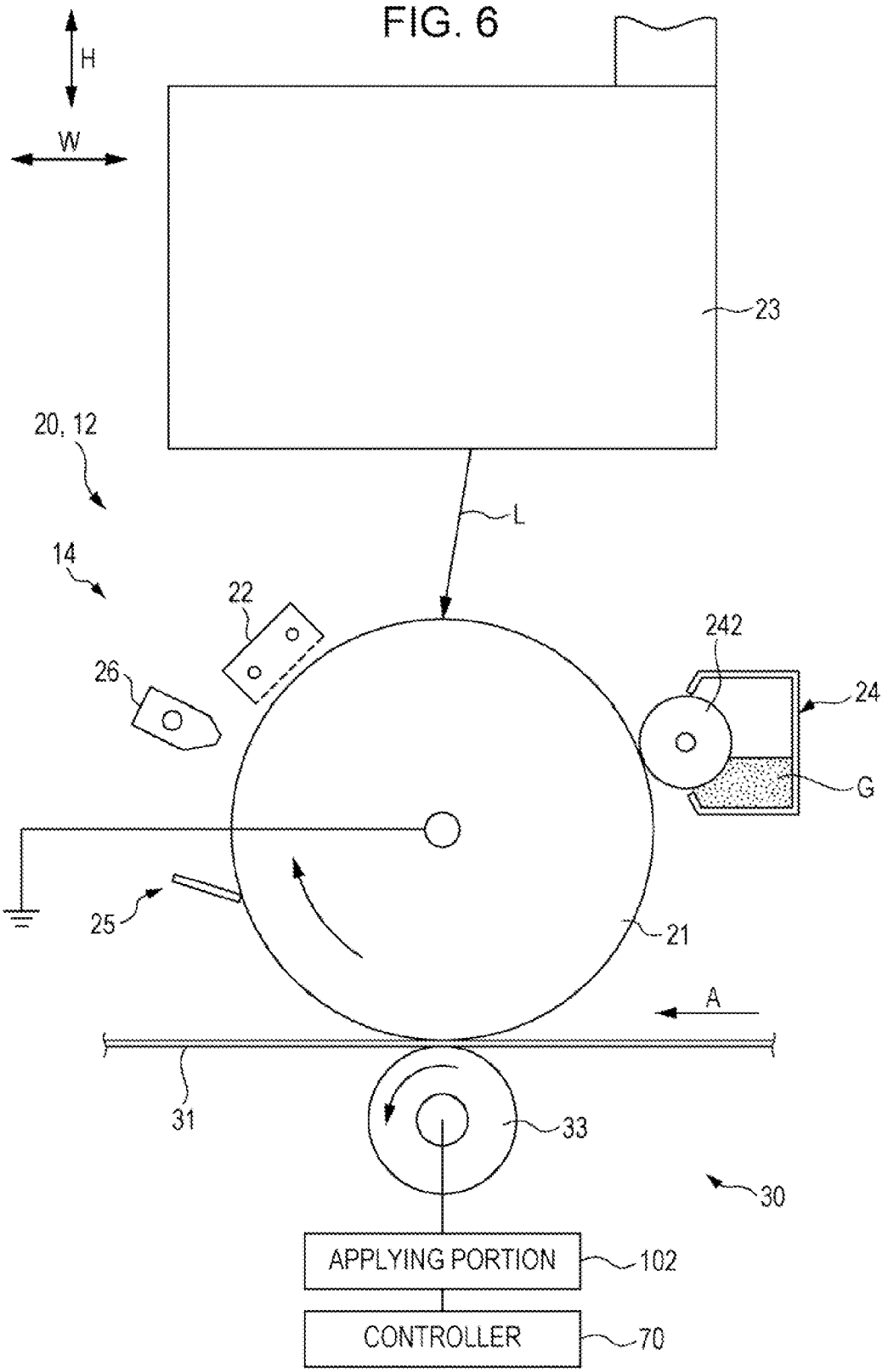
FIG. 6 is a diagram showing the configuration of an image forming section provided in the image forming apparatus according to the first exemplary embodiment of the present invention.
Figure 7:
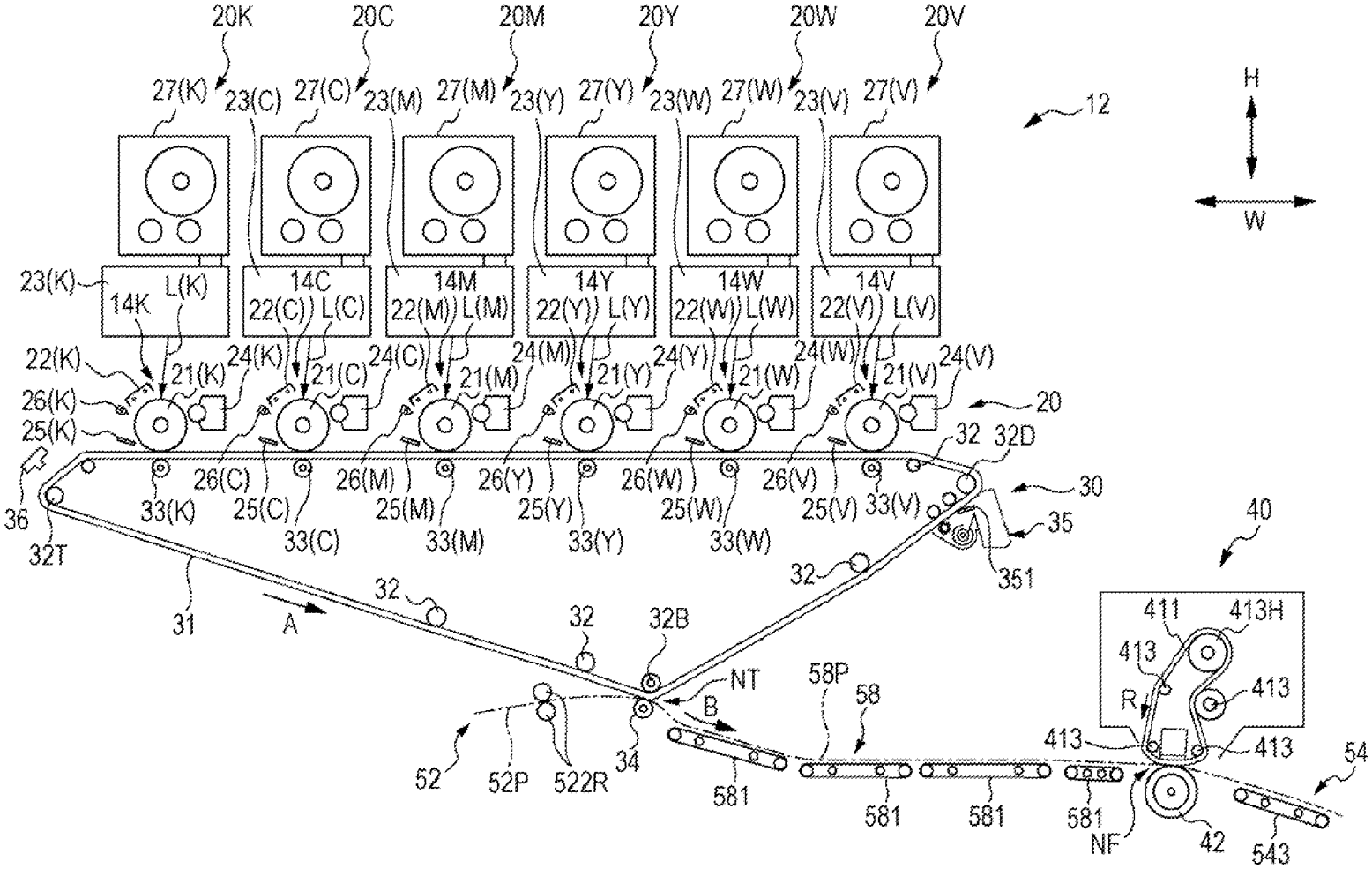
FIG. 7 is a schematic diagram showing the configuration of the image forming section or the image forming apparatus according to the first exemplary embodiment of the present invention.
Figure 8:
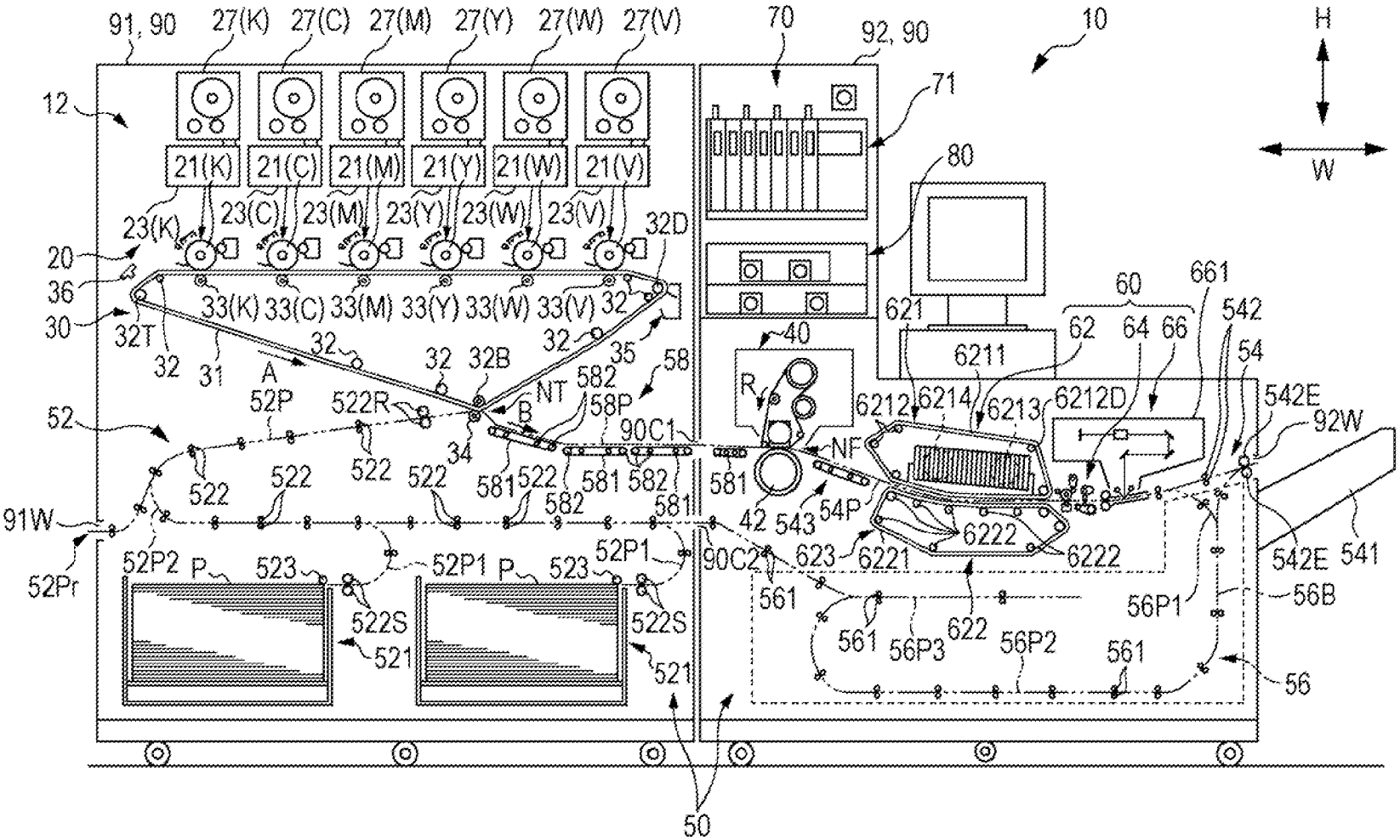
FIG. 8 is a schematic diagram showing the configuration of the image forming apparatus according to the first exemplary embodiment of the present invention.

Exemplary transfer device, image forming apparatus, and transfer method according to a first exemplary embodiment of the present invention will be described with reference to FIGS. 1 to 8. In the drawings, arrow H indicates the top-bottom direction of the apparatus, i.e., the vertical direction, and arrow W indicates the width direction of the apparatus, i.e., the horizontal direction. Overall Configuration of Image Forming Apparatus FIG. 8 is a schematic front view showing the overall configuration of an image forming apparatus 10. As shown in FIG. 8, the image forming apparatus 10 includes an image forming section 12 that forms an image on a sheet member p, serving as a recording medium, using an electrophotographic system; a medium transport device 50 that transports the sheet member P; and a post-processing section 60 that performs post-processing etc. on the sheet member P having an image formed thereon.

The image forming apparatus 10 further includes a controller 70 that controls the above-mentioned sections and a power supply unit 80 described below, and the power supply unit 80 that supplies power to the above-mentioned sections, including the controller 70.

Furthermore, the image forming section 12 includes toner-image forming portions 20 that form toner images, a transfer device 30 that transfers the toner images formed by the toner-image forming portions 20 to a sheet member P, and a fixing device 40 that fixes the toner image transferred to the sheet member P onto the sheet member P.

The medium transport device 50 includes a medium feeding portion 52 that feeds a sheet member P to the image forming section 12, and a medium discharge portion 54 that discharges the sheet member P having a toner image formed thereon. Furthermore, the medium transport device 50 includes a medium returning portion 56 that is used when an image is to be formed on either side of a sheet member P, and an intermediate transport portion 58 (described below).

The post-processing section 60 includes a medium cooling unit 62 that cools a sheet member P to which a toner image has been transferred in the image forming section 12, a straightening device 64 that straightens a curled sheet member P, and an image inspection portion 66 that inspects an image formed on the sheet member P. The components of the post-processing section 60 are disposed in the medium discharge portion 54 of the medium transport device 50.

The components of the medium transport device 50, except for a discharged-medium receiving portion 541 constituting the medium discharge portion 54, are disposed in a housing 90 of the image forming apparatus 10. The housing 90 according to this exemplary embodiment is formed of a first housing 91 and a second housing 92 that are arranged side-by-side in the apparatus width direction. Thus, the unit of transportation of the image forming apparatus 10 is reduced in the apparatus width direction.

The first housing 91 accommodates the principal parts of the image forming section 12, except for the fixing device 40; and the medium feeding portion 52. The second housing 92 accommodates the fixing device 40 constituting the image forming section 12; the medium discharge portion 54, except for the discharged-medium receiving portion 541; the medium cooling unit 62; the image inspection portion 66; the medium returning portion 56; the controller 70; and the power supply unit 80. The first housing 91 and the second housing 92 are coupled together with fastening members, such as bolts and nuts (not shown). The first housing 91 and the second housing 92 have, at their boundaries, a communication opening 90C1 through which a sheet member P is transported from a transfer nip NT (described below) of the image forming section 12 to a fixing nip NF, and a communication path 90C2 through which the sheet member P is transported from the medium returning portion 56 to the medium feeding portion 52.

Image Forming Section

As has been described above, the image forming section 12 includes the toner-image forming portions 20, the transfer device 39, and the fixing device 30. The toner-image forming portions 20 are provided so as to form toner images of the respective colors. In this exemplary embodiment, six toner-image forming portions 20 corresponding to first special color (V), second special color (W), yellow (Y), magenta (M), cyan (C), and black (K) are provided. The letters (V), (W), (Y), (M), (C), and (K) shown in FIG. 7 indicate the above-mentioned colors. The transfer device 30 transfers a toner image, which includes six color toner images first-transferred in an overlapping Banner, from the transfer belt 31 to a sheet member P, at the transfer nip NT (a detailed description will be given below).

In this exemplary embodiment, for example, the first special color (V) is silver, which uses a toner containing flat pigment particles for adding metallic shine or brilliance (sparkle) to an image. The second special color (W) is a corporate color specific to a user, which is more frequently used than the other colors. The silver toner and the control of the respective portions by the controller 70 when an image is formed with the silver toner will foe described below.

Toner-Image Forming Portion

The toner-image forming portions 20 for the respective colors have basically the same configuration, except for the toners they use. Therefore, image forming units 14 for the respective colors will be described below without distinction. As shown in FIG. 6, the image forming units 14 of the toner-image forming portions 20 each includes a photoconductor drum 21, which is an exemplary image carrier; a charger 22; an exposure device 23; a developing device 24, which is an exemplary developing unit; a cleaning device 25; and a static eliminator 26.

Photoconductor Drum

The photoconductor drum 21 is cylindrical, grounded, and rotated about a shaft thereof by a driving device (not shown). The photoconductor drum 21 has, for example, a negatively charged photosensitive layer on the surface thereof. As shown in FIG. 7, in front view, the photoconductor drums 21 for the respective colors are arranged linearly in the apparatus width direction.

Charger

As shown in FIG. 6, the charger 22 negatively charges the surface (photosensitive layer) of the photoconductor drum 21. In this exemplary embodiment, the charger 22 is a scorotron charger of a corona discharge type (non-contact charging type).

Exposure Device

The exposure device 23 forms an electrostatic latent image on the surface of the photoconductor drum 21. More specifically, the exposure device 23 irradiates the surface of the photoconductor drum 21, charged by the charger 22, with exposure light L modulated according to image data received from an image signal processing portion 71 (see FIG. 8) constituting the controller 70. Due to the radiation of the exposure light L by the exposure device 23, an electrostatic latent image is formed on the surface of the photoconductor drum 21.

Developing Device

The developing device 24 forms a toner image on the surface of the photoconductor drum 21 by developing, with developer G containing toner, the electrostatic latent image formed on the surface of the photoconductor drum 21. The developing device 24 is supplied with toner from a toner cartridge 27 (see FIG. 8) containing the toner.

Cleaning Device

The cleaning device 25 is blade-shaped and is used to scrape off the toner, remaining on the surface of the photoconductor drum 21 after the transfer of the toner image to the transfer device 30, from the surface of the photoconductor drum 21.

Static Eliminator

The static eliminator 26 eliminates static by irradiating, with light, the photoconductor drum 21 after transferring the image. By doing so, the charging history of the surface of the photoconductor drum 21 is deleted.

Transfer Device

The transfer device 30 first-transfers, in an overlapping manner, toner images on the photoconductor drums 21 for the respective colors to the transfer bolt 31 and then second-transfers the thus-first-transferred toner image to a sheet member P. A detailed description will be given below.

Transfer Belt

As shown in FIG. 7, the transfer belt 31 is an endless belt that is wound around multiple rollers 32 and supported in a certain orientation. In this exemplary embodiment, the transfer belt 31 has, in front view, an inverted obtuse triangular shape elongated in the apparatus width direction. Of the multiple rollers 32, a roller 32D shown in FIG. 7 serves as a driving roller that rotates the transfer belt 31 in an arrow A direction, using the power supplied by a motor (not shown).

Furthermore, of the multiple rollers 32, a roller 32T shown in FIG. 7 serves as a tension roller that applies tension to the transfer belt 31. Of the multiple rollers 32, a roller 32B shown in FIG. 7 serves as an opposing roller for a second transfer roller 34 (described below). The lower apex portion of the transfer belt 31, which has an inverted obtuse triangular shape as described above, is wound around this roller 32B. The upper edge of the transfer belt 31, extending in the apparatus width direction in the above-described orientation, is in contact with the photoconductor drums 21 for the respective colors from below.

First Transfer Roller

As shown in FIG. 6, first transfer rollers 33, which are an exemplary transfer portion, that transfer toner images on the photoconductor drams 21 to the transfer belt 31 are provided inside the transfer belt 31. The first transfer rollers 33 are disposed so as to face the corresponding photoconductor drums 21 with the transfer belt 31 therebetween.

Furthermore, the first transfer rollers 33 are provided with applying portions 102 for applying transfer voltage. The applying portions 102 apply a transfer voltage having an opposite polarity to the toner to the first transfer rollers 33. Due to the application or the transfer voltage, the toner images formed on the photoconductor drums 21 are transferred to the transfer belt 31.

Details of the transfer voltage applied to the first transfer rollers 33 by the applying portions 102 will foe described below.

Second Transfer Roller

Figure 1:
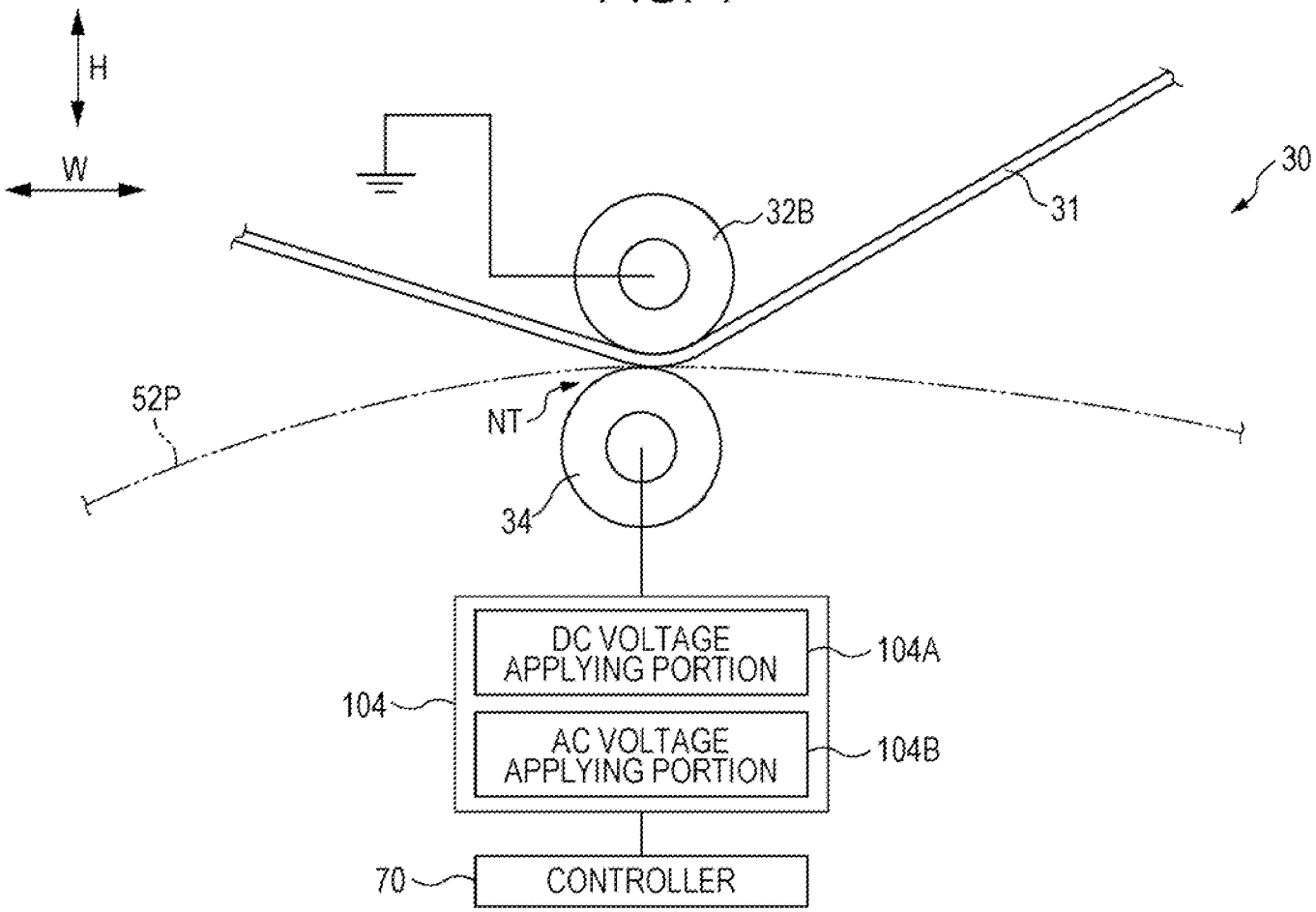
FIG. 1 is a side view showing a second transfer roller, which is used in a transfer device according to a first exemplary embodiment of the present invention, and the vicinity thereof.

Furthermore, as shown in FIG. 1, the transfer device 30 includes the second transfer roller 34 that transfers the toner image (i.e., overlapping toner images) on the transfer belt 31 to the sheet member P. The transfer device 30 is an exemplary transfer portion. The second transfer roller 34 is disposed so as to face the grounded roller 32B with the transfer belt 31 therebetween, forming the transfer nip NT between the transfer belt 31 and the second transfer roller 34. A sheet member P is supplied from the medium feeding portion 52 to the transfer nip NT at appropriate timing.

Furthermore, an applying portion 104 that applies transfer voltage to the second transfer roller 34 is provided. The applying portion 104 applies a transfer voltage having an opposite polarity to the toner to the second transfer roller 34. Due to the application of the transfer voltage, the toner image is transferred from the transfer belt 31 to the sheet member P passing through the transfer nip NT.

Details of the transfer voltage applied to the second transfer roller 34 by the applying portion 104 will be described below.

Cleaning Device

As shown in FIG. 7, the transfer device 30 includes a cleaning device 35 that cleans the transfer belt 31 after the second transfer. The cleaning device 35 is disposed on the downstream side of a portion where the second transfer is performed (i.e., the transfer nip NT) and on the upstream side of a portion where the first transfer is performed, in the rotation direction of the transfer belt 31. The cleaning device 35 includes a blade 351 for scraping off toner remaining on the surface of the transfer belt 31.

Fixing Device

The fixing device 40 fixes a toner image transferred to a sheet member P in the transfer device 30 onto the sheet member P. In this exemplary embodiment, the fixing device 40 fixes the toner image onto the sheet member P by applying heat and pressure to the toner image at the fixing nip NF formed by a pressure roller 42 and a fixing belt 411 wound around multiple rollers 413. A roller 413H is a heating roller that has a heater therein and is rotated by a driving force transmitted from a motor (not shown). Thus, the fixing belt 411 is rotated in an arrow H direction.

The pressure roller 42 is also rotated by a driving force transmitted from a motor (not shown), at the same circumferential velocity as the fixing belt 411.

Medium Transport Device

As shown in FIG. 8, the medium transport device 50 includes the medium feeding portion 52, the medium discharge portion 54, the medium, returning portion 56, and the intermediate transport portion 58.

Medium Feeding Portion

The medium feeding portion 52 includes containers 521 that accommodate a stack of sheet members P. In this exemplary embodiment, two containers 521 are disposed side-by-side in the apparatus width direction, below the transfer device 30.

Medium supply paths 52P, which extend from the containers 521 to the transfer nip NT (the second transfer position), are formed of multiple transport roller pairs 522, guides (not shown), etc. Each medium supply path 52P turns back at two turn-back portions 52P1 and 52P2 in the apparatus width direction and extends upward to the transfer nip NT, forming a substantially S shape.

A feeding roller 523 is provided above the container 521 to feed a sheet member P at the top of the stack of sheets in the container 521. Of the multiple transport roller pairs 522, a transport roller pair 522S located on the most upstream side in the sheet transport direction serves as separating rollers that separate sheet members P, fed in a stacked manner from the container 521 by the feeding roller 523, into individual sheet members P. Furthermore, of the multiple transport roller pairs 522, a transport roller pair 522R located immediately upstream of the transfer nip NT in the sheet transport direction is operated so as to match the timing of moving the toner image on the transfer belt 31 and the timing of transporting the sheet member P.

The medium feeding portion 52 further includes an auxiliary transport path 52Pr. The auxiliary transport path 52Pr extends from an opening 91W, which is provided in a wall of the first, housing 91 farther from the second housing 92, and joins the turn-back portion 52P2 of the medium supply paths 52P. The auxiliary transport path 52Pr serves as a transport path that is used to feed a sheet member P, fed from an optional recording medium supply device (not shown) provided adjacent to the opening 91W in the first housing 91, to the image forming section 12.

Intermediate Transport portion

As shown in FIG. 7, the intermediate transport portion 58 is disposed between the transfer nip NT in the transfer device 30 and the fixing nip NF in the fixing device 40 and includes multiple transport portions 581 each formed of an endless transport belt wound around rollers.

The transport portions 581 transport a sheet member P with the transport belts while sucking air (negative pressure suction) from the inside of the transport portions 581 to make the sheet, member P adhere to the surfaces of the transport belt.

Medium Discharge Unit

As shown in FIG. 8, the medium discharge portion 54 discharges a sheet member P having a toner image fixed thereon by the fixing device 40 in the image forming section 12 to the outside of the housing 90 from, a discharge port 92W provided, in a wall of the second housing 92 farther from the first housing 91.

The medium discharge portion 54 includes the discharged-medium receiving portion 541 that, receives the sheet member P discharged from the discharge port 92W.

The medium discharge portion 54 includes a medium discharge path 54P that transports the sheet member P from the fixing device 40 (fixing nip NF) to the discharge port 92W. The medium discharge path 54P is formed of a belt transport portion 543, multiple roller pairs 542, guides (not shown), etc. Of the multiple roller pairs 542, a roller pair 542B disposed on the most downstream side in a sheet discharge direction serves as discharge rollers that discharge the sheet member P onto the discharged-medium receiving portion 541.

Medium Returning Unit

The medium returning portion 56 includes multiple roller pairs 561. The multiple roller pairs 561 form a reversing path 56P, into which a sheet member P that has passed through the image inspection portion 66 is fed when an image is to be formed on either side of the sheet member P. The reversing path 56P includes a diverging path 56P1, a transport path 56P2, and a reversing path 56P3. The diverging path 56P1 diverges from the medium discharge path 54P. The transport path 56P2 sends the sheet member P received from the diverging path 56P1 into the medium supply paths 52P. The reversing path 56P3 is provided in the middle of the transport path 56P2. By reversing the direction in which the sheet member P is transported along the transport path 56P2 (i.e., by performing switchback transportation), the reversing path 56P3 reverses the sheet member P.

Post-Processing Section

The medium cooling unit 62, the straightening device 64, and the image inspection portion 66 constituting the post-processing section 60 are disposed on the upstream side, in the sheet discharge direction, of a diverging portion of the diverging path 56P1 of the medium discharge path 54P of the medium discharge portion 54, in this order from the upstream side in the discharged direction.

Medium Cooling Unit

The medium cooling unit 62 includes a heat-absorbing device 621 that absorbs the heat of the sheet member P, and a pressing device 622 that presses the sheet member P onto the heat-absorbing device 621. The heat-absorbing device 621 is disposed above the medium discharge path 54P, and the pressing device 622 is disposed below the medium discharge path 54P.

The heat-absorbing device 621 includes an endless heat-absorbing belt 6211, multiple rollers 6212 that support the heat-absorbing belt 6211, a heat sink 6213 disposed inside the heat-absorbing belt 6211, and a fan 6214 for cooling the heat sink 6213.

The outer circumferential surface of the heat-absorbing belt 6211 is in contact with the sheet member P so as to be able to exchange heat. Of the multiple rollers 6212, a roller 6212D serves as a driving roller that transmits a driving force to the heat-absorbing belt 6211. The surface of the heat sink 6213 is in sliding contact with the inner circumferential surface of the heat-absorbing belt 6211 in a predetermined area along the medium discharge path 54P.

The pressing device 622 includes an endless pressing belt 6221 and multiple rollers 6222 that support the pressing belt 6221. The pressing belt 6221 is wound around the multiple rollers 6222. The pressing device 622 transports the sheet member P in cooperation with the heat-absorbing belt 6211 by pressing the sheet member P against the heat-absorbing belt 6211 (heat sink 6213).

Straightening Device

The straightening device 64 is provided on the downstream side of the medium cooling unit 62 in the medium discharge portion 54. The straightening device 64 straightens the curled sheet member P received from the medium cooling unit 62.

Image Inspection Portion

An in-line sensor 661 that constitutes the principal part of the image inspection portion 66 is disposed on the downstream side of the straightening device 64 in the medium discharge portion 54. The in-line sensor 661 detects the presence/absence and level of toner intensity defect, image defect, image position defect, etc, in a fixed toner image, on the basis of light emitted onto and reflected from the sheet member P.

Image Forming Operation (Action) of Image Forming Apparatus

Next, the outline of an image forming process and subsequent post-processing process performed on a sheet member P by the image forming apparatus 10 will be described.

As shown in FIG. 8, upon receipt of an image forming instruction, the controller 70 operates the toner-image forming portions 20, the transfer device 30, and the fixing device 40. As a result, as shown in FIG. 6, the photoconductor drums 21 of the image forming units 14 and developing rollers 242 of the developing devices 24 for the respective colors are rotated, and the transfer belt 31 is rotated. Furthermore, the pressure roller 42 is rotated, and the fixing belt 411 is rotated. In synchronization with the operation of these portions, the controller 70 operates the medium transport device 50 etc.

As a result, the photoconductor drums 21 for the respective colors are charged, by the chargers 22 while being rotated. Furthermore, the controller 70 sends image data processed in the image signal processing portion to the exposure devices 23. The exposure devices 23 expose the charged photoconductor drums 21 to exposure light L modulated according to the image data. As a result, electrostatic latent images are formed on the surfaces of the photoconductor drums 21. The electrostatic latent images formed on the photoconductor drums 21 are developed by developer supplied from the developing devices 24. In this way, toner images of first special color (V), second special color (W), yellow (Y), magenta (M), cyan (C), and black (K) are formed on the corresponding photoconductor drums 21.

The color toner images formed on the photoconductor drums 21 are sequentially transferred to the rotating transfer belt 31 due to the application of a transfer voltage via the first transfer rollers 33. Thus, an overlapping toner image, in which toner images of six colors overlap one another, is formed on the transfer belt 31. This overlapping toner image is transported to the transfer nip NT by the rotation of the transfer belt 31.

As shown in FIG. 8, a sheet member P is supplied to the transfer nip NT by the transport roller pair 522R of the medium feeding portion 52 so as to be timed with the transportation of the overlapping toner image. When a transfer voltage is applied at the transfer nip NT, the overlapping toner image is transferred from the sheet member P to the transfer belt 31.

The sheet member P to which the toner image has been transferred is transported from the transfer nip NT in the transfer device 30 to the fixing nip NF in the fixing device 40 by the intermediate transport portion 58. The fixing device 40 applies heat and pressure to the sheet member P passing through the fixing nip NF. Thus, the toner image transferred to the sheet member P is fixed.

The sheet member P discharged from the fixing device 40 is transported to the discharged-medium receiving portion 541 outside the apparatus by the medium discharge portion 54 and, at the same time, is processed by the post-processing section 60. The sheet member P heated in the fixing process is first cooled by the medium cooling unit 62. Then, the sheet member P is straightened by the straightening device 64. Then, the toner image fixed to the sheet member P is subjected to the detection for the presence/absence and level of toner intensity defect, image defect, image position defect, etc. by the image inspection portion 66. Finally, the sheet member P is discharged onto the medium discharge portion 54.

On the other hand, when an image is to be formed on a non-image surface (a surface having no image) of a sheet member P (i.e., when double-sided printing is performed), the controller 70 switches the transport path for the sheet member P after passing the image inspection portion 66 from the medium discharge path 54P of the medium, discharge portion 54 to the diverging path 56P1 of the medium returning portion 56. As a result, the sheer member P is reversed via the reversing path 56P and is sent to the medium supply paths 51P. An image is formed (fixed) on the back surface of this sheet member P through the same image forming process as that performed on the front surface thereof. This sheet member P is discharged onto the discharged-medium receiving portion 541 outside the apparatus after going through the same process as that performed on the front surface thereof after forming an image.

Configuration of Relevant Part

Next, sliver toner used as first special color (V) will be described.

Toner

Figure 3A:
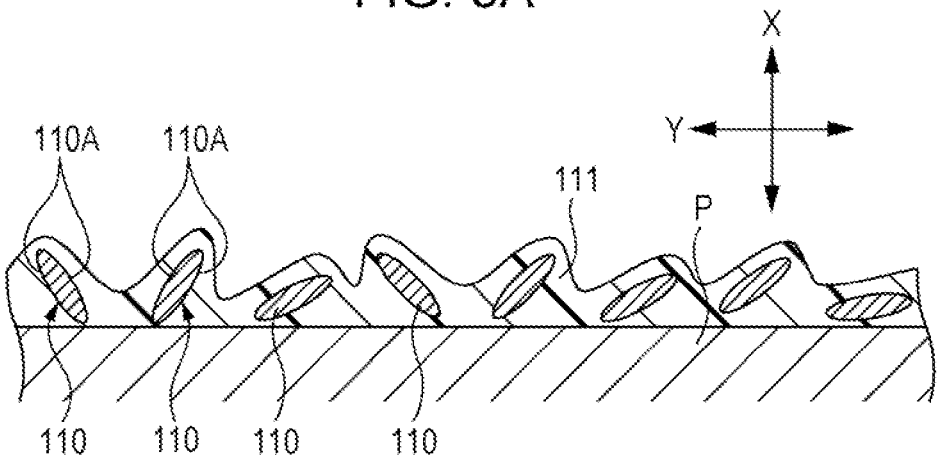
FIGS. 3A and 3B are sectional views showing the orientation of flat pigment particles contained in a toner image formed by the transfer device and an image forming apparatus according to the first exemplary embodiment of the present invention.

The silver toner used as the first special color (V) (hereinbelow, simply "silver toner") contains, as shown in FIG. 3A, pigment particles 110, which are an example of flat pigment, and binder resin 111. By using the silver toner, images having brilliance (sparkle) or metallic gloss are obtained.

Figure 5A:
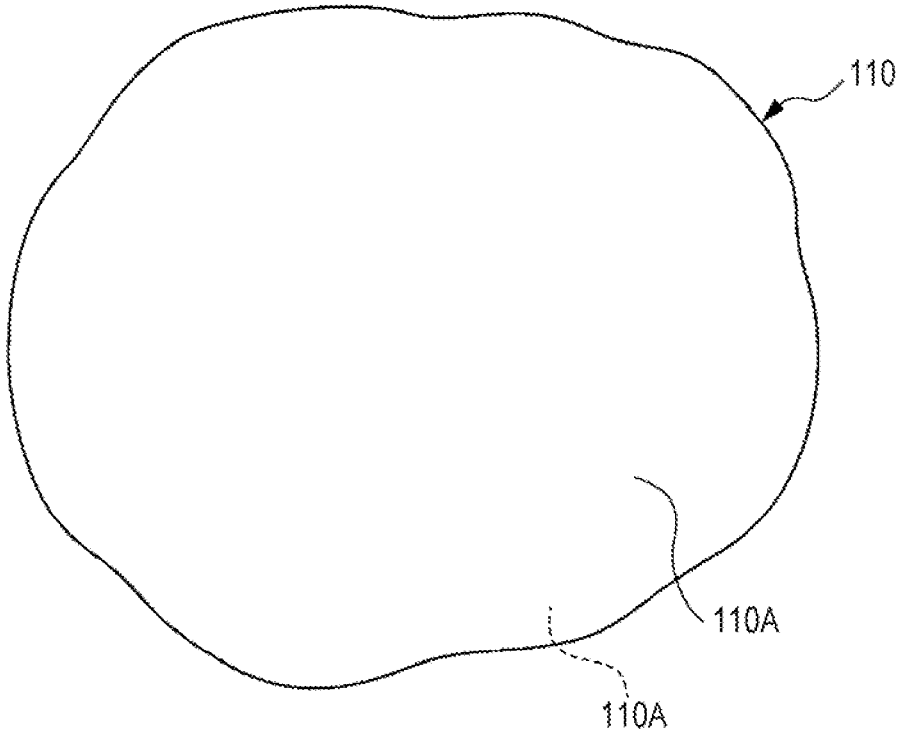
FIGS. 5A and 5B are a plan view and a side view, respectively, of a flat pigment particle contained in a toner used in the image forming apparatus according to the first exemplary embodiment of the present invention.
Figure 5B:
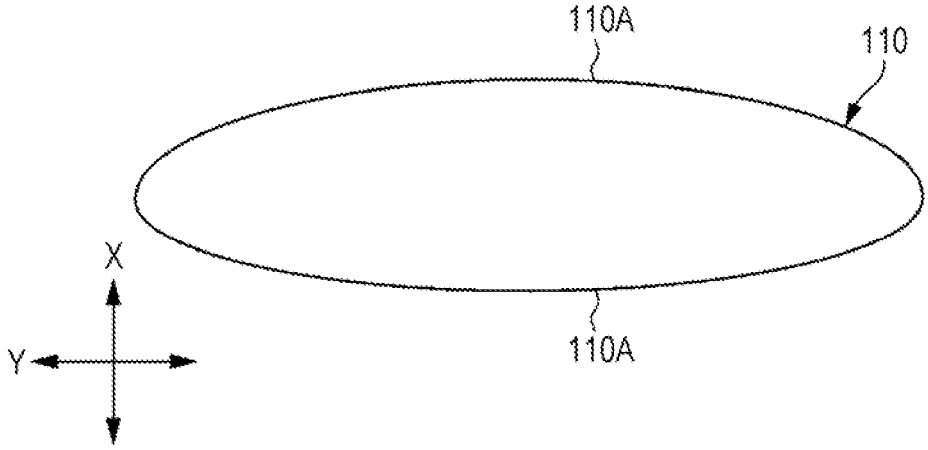

The pigment particle 110 is composed of, for example, aluminum. When the pigment particle 110 disposed on a flat surface is viewed from the side, the pigment particle 110 is larger in the left-right direction (direction Y) than in the top-bottom direction (direction X), as shown in FIG. 5B. The ratio of the dimension of the pigment particle 110 in the left-right direction to that in the top-bottom direction is greater than those of pigment particles of toners of other colors.

Furthermore, the pigment particle 110 in plan view (FIG. 5A) is wider than that in side view (FIG. 5B). The pigment particle 110 has a pair of reflection surfaces 110*a* (an exemplary flat surface) that face up and down when disposed on a flat surface (see FIG. 5B). The pigment particles 110 have a flat shape.

In this way, in the first exemplary embodiment, the toner-image forming portion 20V serves as an exemplary first image portion that forms a toner image with a toner containing the pigment particles 110.

On the other hand, toners of second special, color (W), yellow (Y), magenta (M), cyan (C), and black (K) that are used in the toner-image forming portions 20W, 20Y, 20M, 20C, and 20K (hereinbelow, 20W to 20K) do not contain a Hat pigment, but contain a binder resin and a pigment other than a flat pigment (for example, an organic pigment, or an inorganic pigment). These pigments have ball-like shape, compared, with the pigment particles 110. Herein, for ease of explanation, second special color (W), yellow (Y), magenta (M), cyan (C), and black (K) are referred to as "other colors", and other color toners are referred to as "other color toners".

In this way, in the first exemplary embodiment, the toner-image forming portions 20W to 20K serve as exemplary second image portions that form toner images with toners that do not contain a flat pigment.

Furthermore, the image forming apparatus 10 according to the first exemplary embodiment has monochrome mode for forming a silver toner image on a sheet member P without forming other color toner images; other color mode for forming ah least one other color toner image on a sheet member P without forming a silver toner image; and mixed-color mode for forming a silver toner image and at least one other color toner image on a sheet member P. In the mixed-color mode, a silver toner image and another color toner image may be formed either in an overlapping manner or side-by-side.

The monochrome mode further includes monochrome brilliance mode for increasing the brilliance (sparkle), and monochrome glossy mode for increasing the metallic gloss. Similarly, the mixed-color mode has mixed-color brilliance mode for increasing the brilliance (sparkle) and mixed-color glossy mode for increasing the metallic gloss.

Applying Portion

As shown in FIG. 6, the controller 70 controls a DC voltage, serving as a transfer voltage, applied to the first transfer roller 33 via the applying portion 102.

On the other hand, the applying portion 104 that applies a transfer voltage to the second transfer roller 34 includes, as shown in FIG. 1, a DC voltage applying portion 104A (an exemplary DC voltage applying portion) that applies a DC voltage to the second transfer roller 34; and an AC voltage applying portion 104B (an exemplary AC voltage applying portion) that applies an AC voltage to the second transfer roller 34. The controller 70 controls the transfer voltage applied via the applying portion 104.

Controller

Other Color Mode

The other color mode is performed by the controller 70 operating at least one of the toner-image forming portions 20W to 20K, and not the toner-image forming portion 20V. Furthermore, when the other color mode is performed, as shown in FIG. 1, the controller 70 operates the DC voltage applying portion 104A, and not the AC voltage applying portion 104B, to apply only a DC voltage to the second transfer roller 34.

In addition, in the other color mode, the controller 70 operates the applying portions 102 to apply the same DC voltages to the first transfer rollers 33 for the respective colors (see FIG. 6).

Monochrome Brilliance Mode

The monochrome brilliance mode is performed by the controller 70 operating the toner-image forming portion 20V, and not the toner-image forming portions 20W to 20K. Furthermore, in the monochrome brilliance mode, as shown in FIG. 1, the controller 70 operates the DC voltage applying portion 104A and the AC voltage applying portion 104B to apply a superimposed voltage, in which a DC voltage and an AC voltage are superimposed on each other, to the second transfer roller 34 (superimpose mode).

Figure 2:
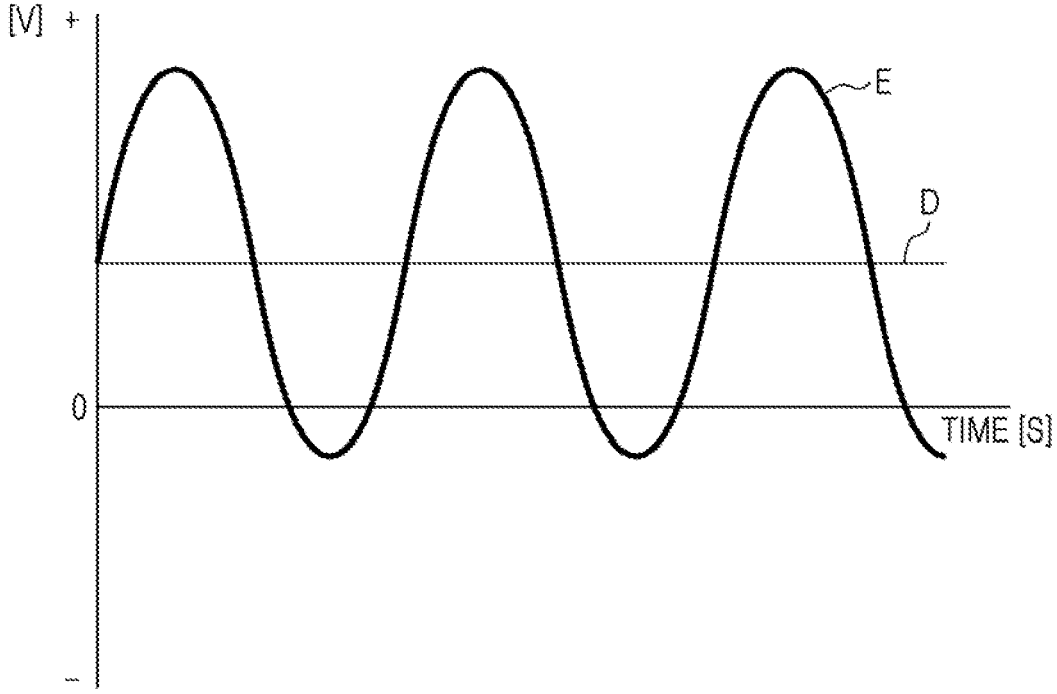
FIG. 2 is a graph showing a voltage applied to the second transfer roller used in the transfer device according to the first exemplary embodiment of the present invention.

FIG. 2 shows a graph of a super imposed voltage applied to the second transfer roller 34, in which the vertical axis indicates the voltage [V], and the horizontal axis indicates the time [S]. A superimposed voltage to be applied to the second transfer roller 34 is obtained by superimposing an AC voltage produced by the AC voltage applying portion 104B (in FIG. 2, a voltage E expressed by a sine wave) on a DC voltage produced by the DC voltage applying portion 104A (in FIG. 2, a straight wave D). The AC voltage applied by the AC voltage applying portion 104B is controlled so as change in accordance with the DC voltage produced by the DC voltage applying portion 104A. The DC voltage applying portion 104A produces a DC voltage having a polarity that causes toner on the photoconductor drum 21 to be transferred to the sheet member P. In FIG. 2, a negatively charged toner is used, so, the DC voltage applying portion 104A produces a positive DC voltage.

Furthermore, in the monochrome brilliance mode, the controller 70 operates the applying portions 102 to apply a predetermined DC voltage to the first transfer rollers 33 (see FIG. 6).

Monochrome Glossy Mode

The monochrome glossy mode is performed by the controller 70 operating the toner-image forming portion 20V, and not the toner-image forming portions 20W to 20K. Furthermore, in the monochrome glossy mode, as shown in FIG. 1, the controller 70 operates the DC voltage applying portion 104A, and not the AC voltage applying portion 104B, to apply only a DC voltage to the second transfer roller 34 (direct-current mode). In this way, the controller 70 serves as an exemplary switching portion that switches the DC voltage applying portion 104A and the AC voltage applying portion 104B between the superimpose mode and the direct-current mode.

Furthermore, in the monochrome glossy mode, the controller 70 operates the applying portions 102 to apply a predetermined DC voltage to the first transfer rollers 33 (see FIG. 6).

Mixed-Color Brilliance Mode

The mixed-color brilliance mode is performed by the controller 70 operating at least one of the toner-image forming portions 20W to 20K, and the toner-image forming portion 20V. Furthermore, in the mixed-color brilliance mode, similarly to the monochrome brilliance mode, the controller 70 operates the DC voltage applying portion 104A and the AC voltage applying portion 104B to apply a superimposed voltage, which is obtained by superimposing an AC voltage on a DC voltage, to the second transfer roller 34 (superimpose mode).

Furthermore, in the mixed-color brilliance mode, the controller 70 operates the applying portions 102 to apply a DC voltage to the first transfer rollers 33 (see FIG. 6). Here, the controller 70 individually controls the applying portions 102 to make a transfer voltage for transferring a toner image to the transfer belt 31 by the first transfer roller 33V (an exemplary first transfer portion) lower than a transfer voltage for transferring toner images to the transfer belt 31 by the first transfer rollers 33W to 33K (exemplary second transfer portions).

Mixed-Color Glossy Mode

The mixed-color glossy mode is performed by the controller 70 operating the toner-image forming portions 20W to 20K and the toner-image forming portion 20V. Furthermore, in the mixed-color glossy mode, similarly to the monochrome glossy mode, the controller 70 operates the DC voltage applying portion 104A, not the AC voltage applying portion 104B, to apply only the DC voltage to the second transfer roller 34 (direct-current mode).

Furthermore, in the mixed-color glossy mode, the controller 70 operates the applying portions 102 to apply a DC voltage to the first transfer rollers 33 (see FIG. 6). Here, similarly to the mixed-color brilliance mode, the controller 70 individually controls the applying portions 102 to mate a transfer voltage for transferring a toner image to the transfer belt 31 by the first transfer roller 33V lower than a transfer voltage for transferring toner images to the transfer belt 31 by the first transfer rollers 33W to 33K.

Action of Relevant Configuration

Next, actions of the relevant configuration will be described.

In the monochrome brilliance mode or the mixed-color brilliance mode, the controller 70 operates the DC voltage applying portion 104A and the AC voltage applying portion 104B to apply a super imposed voltage, which is obtained by superimposing an AC voltage on a DC voltage, to the second transfer roller 34, as shown in FIG. 1. In this way, in the transfer method according to the first exemplary embodiment, when a toner image formed with a toner containing the pigment particles 110 is transferred to a sheet member P to the second transfer roller 34, a superimposed voltage (transfer voltage), which is obtained by superimposing an AC voltage on a DC voltage, is applied to the second transfer roller 34.

When the superimposed voltage serving as a transfer voltage is applied, the pigment particles 110 composed of aluminum, fly (vibrate) between the transfer belt 31 and the sheet member P in a reciprocating manner due to an alternating electric field and then move to the sheet member P.

Figure 4A:
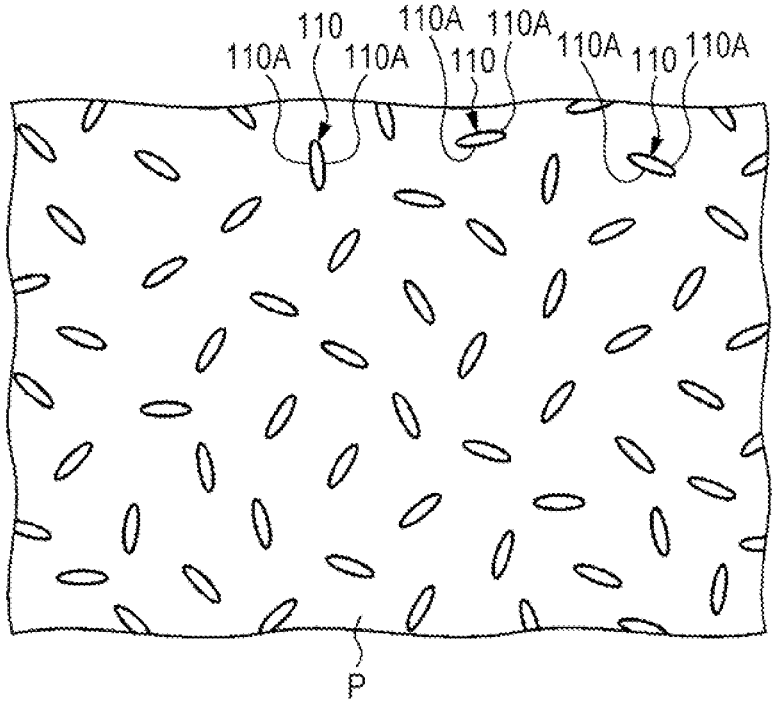
FIGS. 4A and 4B are plan views showing the orientation of flat pigment particles contained in the toner image formed by the transfer device and image forming apparatus according to the first exemplary embodiment of the present invention.

Because the pigment particles 110 move to the sheet member P after flying between the transfer belt 31 and the sheet member P in a reciprocating manner due the orientation of the pigment particles 110 is irregular (random), as shown in FIGS. 3A and 4A. Because the orientation of the reflection, surfaces 110A of the pigment particles 110 is irregular, the direction of reflected light from the image is also irregular.

As a result, diffused reflection light increases as compared with a case where the reflection surfaces 110A of the pigment particles 110 are oriented in the same direction, (see FIGS. 3B and 4B), increasing the brilliance (sparkle). Note that objective evaluation of the brilliance is possible by using, for example, BYK-mac (multi-angle colorimeter), manufactured by Toyo Seiki Seisaku-Sho, Ltd.

On the other hand, in the monochrome glossy mode or the mixed-color glossy mode, the controller 70 operates the DC voltage applying portion 104A and not the AC voltage applying portion 104B, to apply only the DC voltage to the second transfer roller 34, as shown in FIG. 1.

When only a DC voltage, serving as a transfer voltage, is applied, the pigment particles 110 move to the sheet member P without flying between the transfer belt 31 and the sheet member P in a reciprocating manner.

Figure 3B:
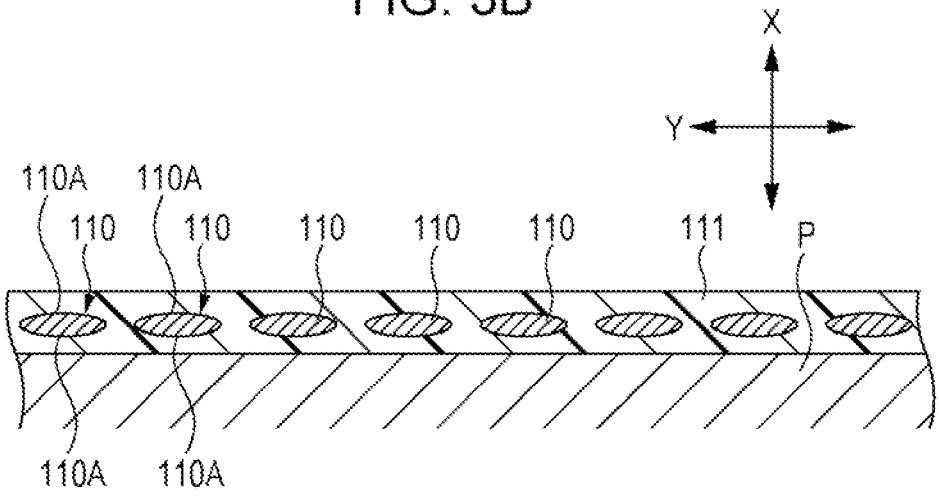
Figure 4B:
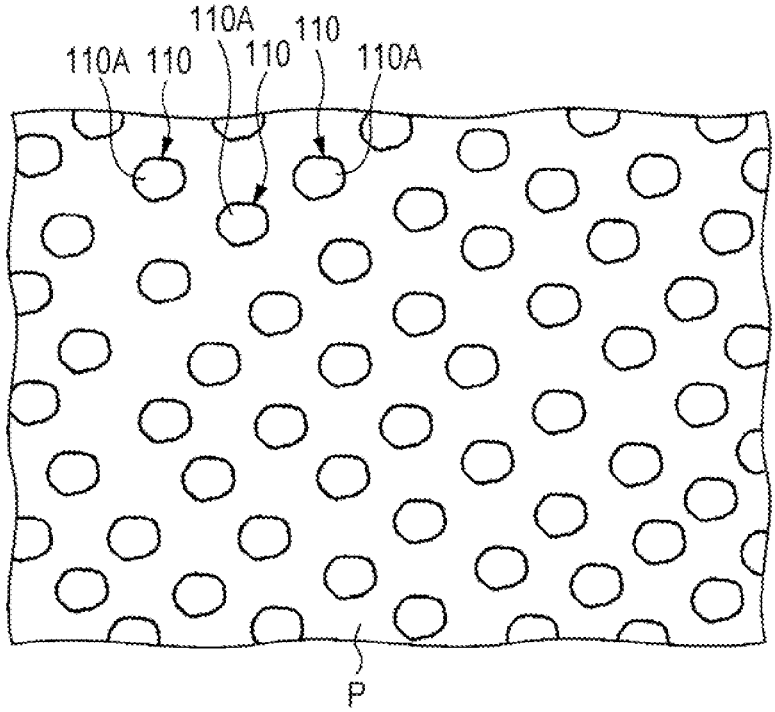

In this way, because the pigment particles 110 move to the sheet member P without flying between the transfer belt 31 and the sheet member P in a reciprocating manner, the pigment particles 110 are oriented such that the flat surfaces 110A are parallel to the surface of the sheet member P, as shown in FIGS. 3B and 4B. That is, the pigment particles 110 are arrayed regularly, and hence, the direction of reflected light from the image is also regular.

More specifically, as shown in FIG. 3B, the reflection surfaces 110A of the pigment particles 110 are oriented in a direction perpendicular to the surface of the sheet member P (i.e., the direction X in FIG. 3B). Furthermore, the pigment particles 110 are arrayed in a direction parallel to the surface of the sheet member P (direction Y in FIG. 3B). The pigment particles 110 with the reflection surfaces 110A oriented in a direction perpendicular to the sheet surface, as shown in FIG. 4B, are arranged on the sheet member P. Hence, the direction of the reflected light from the image gets close to a direction perpendicular to the surface of the sheet member P.

As a result, the flop index (FI), which is the index showing the metallic gloss measured according to ASTM E2194, increases (the metallic gloss increases).

On the other hand, in the mixed-color brilliance mode or the mixed-color glossy mode, the controller 70 individually controls the applying portions 102 so that a lower transfer voltage is applied when a toner image is transferred to the transfer belt 31 by the first transfer roller 33V than when toner images are transferred to the transfer belt 31 by the first transfer rollers 33W to 33K.

As a result, the amount of charge of the pigment particles 110 due to charge injection becomes lower than that in a case where the same transfer voltage is applied to the first transfer roller 33V and to the first transfer rollers 33W to 33K when the toner images are first-transferred to the transfer belt 31. Hence, in the second transfer of the toner image to the sheet member P, the orientation of the pigment particles 110 is easily controlled.

SUMMARY

As has been described above, in the monochrome brilliance mode or the mixed-color brilliance mode, the controller 70 applies a superimposed voltage, which is obtained by superimposing an AC voltage on a DC voltage, to the second transfer roller 34. As a result, an image in which the orientation of the reflection surfaces 110A of the pigment particles 110 is irregular is obtained.

Furthermore, in an image in which the orientation of the reflection surfaces 110A of the pigment particles 110 is irregular, the direction of reflected light from the image is irregular. Therefore, compared with a case where the orientation of the reflection surfaces 110A of the pigment particles 110 is uniform, the diffused reflection light increases, increasing the brilliance (sparkle).

Furthermore, in the monochrome glossy mode or the mixed-color glossy mode, the controller 70 applies only a DC voltage to the second transfer roller 34. As a result, the pigment particles 110 are arrayed in the direction parallel to the surface of the sheet member P (direction Y). That is, the pigment particles 110 are arrayed regularly, and hence, the direction of reflected light from the image is also regular. Therefore, the above-mentioned flop index increases (metallic gloss increases), compared with a case where the orientation of the pigment particles 110 is irregular.

In this manner, it is possible to switch between the monochrome glossy mode or the mixed-color glossy mode for increasing the metallic gloss of an image and the monochrome brilliance mode or the mixed-color brilliance mode for increasing the brilliance (sparkle) of an image, due to the controller 70 operating the respective portions.

Furthermore, in the mixed-color brilliance mode or the mixed-color glossy mode, the controller 70 makes the transfer voltage to be applied when a toner image is transferred to the transfer belt 31 by the first transfer roller 33V lower than that to be applied when toner images are transferred to the transfer belt 31 by the first transfer rollers 33W to 33K. As a result, the charge generated in the pigment particles 110 due to charge injection in the first transfer decreases, compared with a case where the same transfer voltage is applied to the first transfer roller 33V and to the first transfer rollers 33W to 33K. Hence, in the second transfer of the toner image to the sheet member P, the orientation of the pigment particles 110 is easily controlled.

Second Exemplary Embodiment

Exemplary transfer device and image forming apparatus according to a second exemplary embodiment of the present invention will be described below with reference to FIG. 9, focusing on the differences in structure from the first exemplary embodiment. Note that the same components as those in the first exemplary embodiment will be denoted by the same reference numerals, and a description thereof will be omitted.

Configuration

Figure 9:
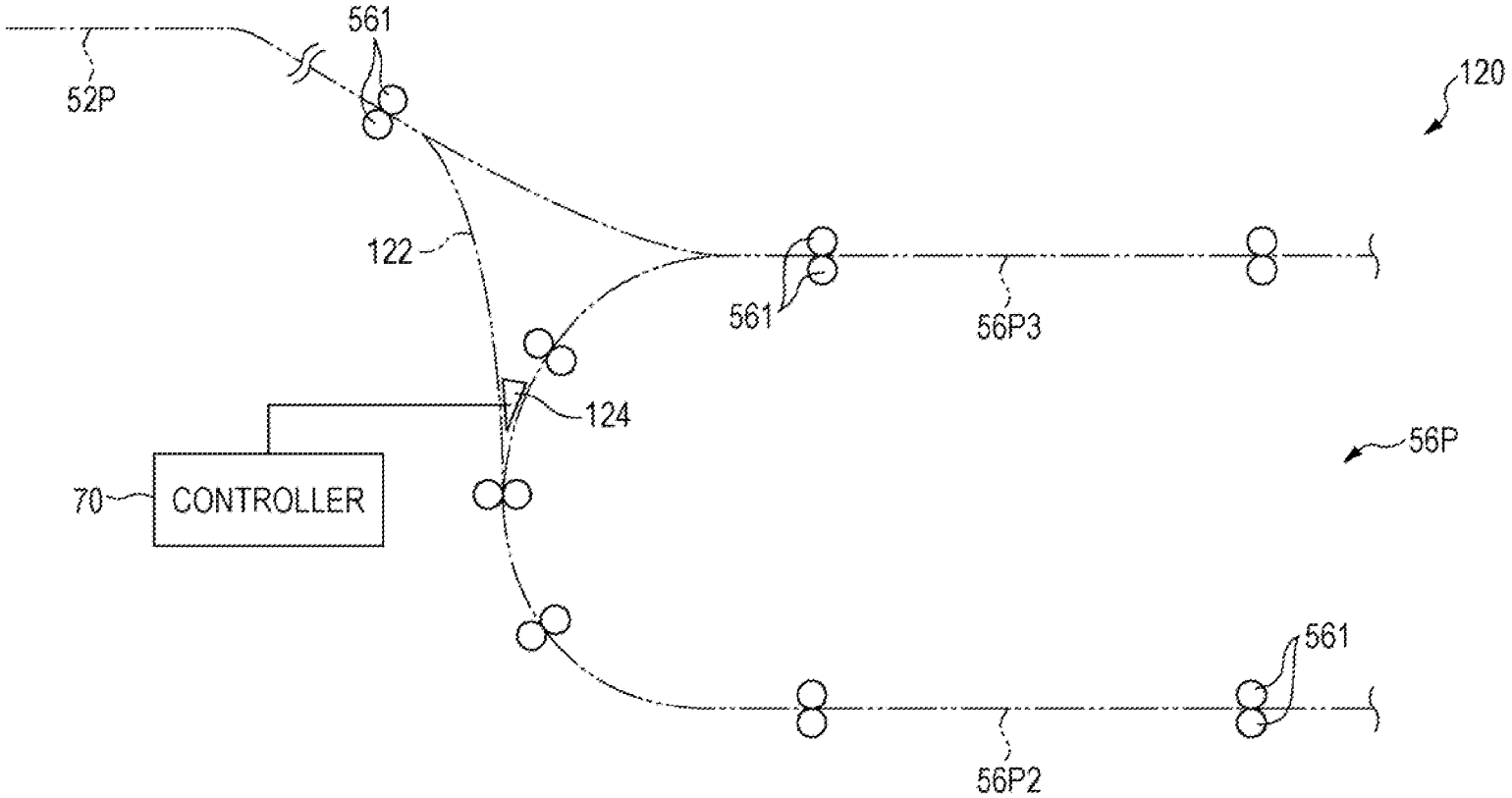
FIG. 9 is a diagram showing the configuration of a medium returning unit of an image forming apparatus according to a second, exemplary embodiment of the present invention.

As shown in FIG. 9, the reversing path 56P of a medium returning unit 120 according to the second exemplary embodiment includes the transport path 56P2 and the reversing path 56P3. The medium returning unit 120 further includes a direct path 122 that feeds a sheet member P, transported along the transport path 56P2, to the medium supply paths 52P, without feeding to the reversing path 56P3. The sheet member P fed to the medium supply paths 52P through the direct path 122, without being fed to the reversing path 56P3, is not reversed.

Furthermore, a guiding portion 124 is provided, which directs a sheet member P transported along the transport path 56P2 to the reversing path 56P3 or to the medium supply paths 52P via the direct path 122. The controller 70 controls the direction in which the guiding portion 124 guides the sheet member P.

Action

Next, the control of the respective portions performed by the controller 70 in an additional printing mode will be described as its action. In the additional printing mode, a toner image is formed on a sheet member P with a toner containing the pigment particles 110, and toner images formed with other color toners are overlaid thereon.

In the additional printing mode, the controller 70 first operates the toner-image forming portion 20V to form only a toner image, among the image data, that is to be formed by the toner-image forming portion 20V. The toner image thus-formed by the toner-image forming portion 20V is transferred, at the transfer nip NT, to a surface of a sheet member P transported thereto (see FIG. 7).

The controller 70 then controls the medium transport device 50 to direct the sheet member P having the toner image transferred and fixed thereto to the medium, returning unit 120, without discharging it to the discharged-medium receiving portion 541. Furthermore, the controller 72 controls the guiding portion 124 to direct, the sheet member P directed to the medium returning unit 120 to the medium supply paths 52P via the direct path 122 (see FIG. 9).

The controller 70 then operates the toner-image forming portions 20W to 20K to form only toner images, among the image data, that are to be formed by the toner-image forming portions 20W to 20K.

The toner images formed by the toner-image forming portions 20W to 20K are transferred, at the transfer nip NT, to the surface of the sheet member P directed to the medium supply paths 52P via the direct path 122. Then, the sheet member P is discharged, onto the discharged-medium receiving portion 541 by the medium transport device 50 (see FIG. 8).

SUMMARY

In the additional printing mode, a toner image formed with a toner containing the pigment particles 110 is formed on a sheet member P, and toner images formed with other color toners are overlaid thereon.

By changing the order in which the toner-image forming portions 20 are arranged, a toner image formed with the toner containing the pigment particles 110 and toner images formed with other color toners may be formed on a sheet member P in this order. However, in this case, the toner-image forming portion 20V has to be provided on the downstream side of the toner-image forming portions 20W to 20K in the rotation direction of the transfer belt 31. In such a configuration, toner images formed on the transfer belt 31 with the other color toners are subjected to the transfer history of the toner-image forming portion 20V located on the downstream, side thereof, increasing the amount of toner transferred back to the photoconductor drums 21. As a result, the color development of the toner images formed with the other color toners decrease.

That is, by forming a toner image with the toner containing the pigment particles 110 on a sheet member P, feeding this sheet member P again to the transfer nip NT, and then overlaying toner images formed with the other color toners on the toner image formed with the toner containing the pigment particles 110, it is possible to obtain an image in which degradation in the color development of the toner images formed with the other color toners is suppressed and in which the metallic gloss or the brilliance (sparkle) is enhanced.

The foregoing detailed descriptions of specific exemplary embodiments of the present invention are not intended to limit the invention to the precise forms disclosed, and obviously many modifications and variations are possible. For example, although not described in the first and second exemplary embodiments, when a toner image formed with the toner containing the pigment particles 110 is to be transferred to a sheet member P, the superimpose mode may be always chosen to enhance the brilliance (sparkle).

Figure 10:
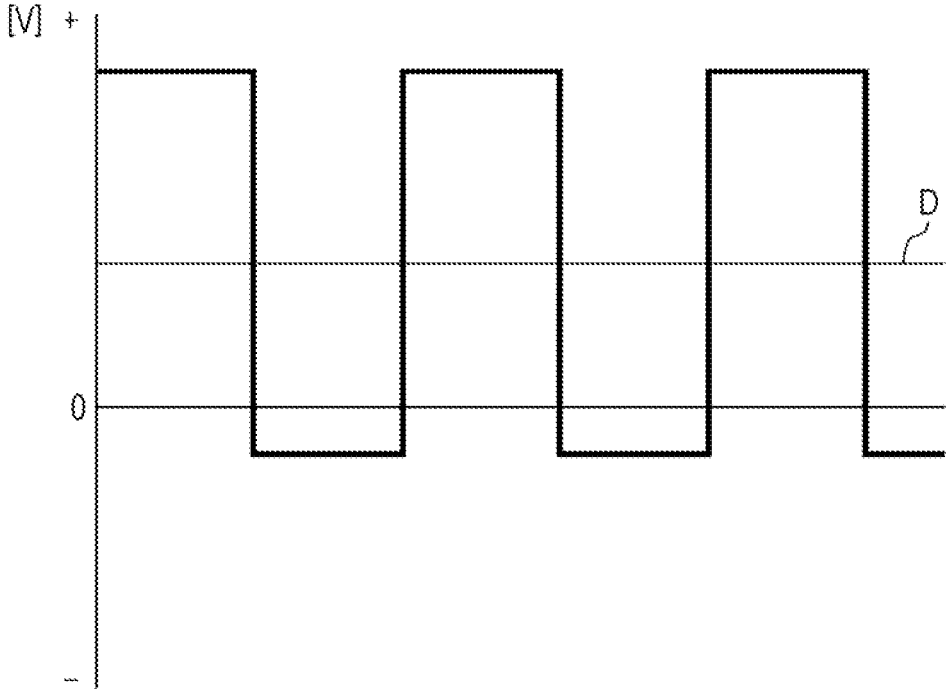
FIG. 10 is a graph, showing a modification of a voltage applied to the second transfer roller that is used in the transfer device according to the first and second exemplary embodiments of the present invention.

Furthermore, although a sine wave voltage is used as the AC voltage in the first and second exemplary embodiments, a rectangular wave voltage, as shown in FIG. 10, may be used.

Furthermore, in the second exemplary embodiment, a sheet member P is fed again to the transfer nip NT via the direct path 122 without reversing the sheet member P. However, it is also possible that a sheet member P having a toner image formed by the toner-image forming portion 20V transferred thereto is discharged onto the discharged-medium receiving portion 541, and the discharged sheet member P is stored again in the container 521 so that the sheet member P is fed again to the transfer nip NT by being transported by the medium feeding portion 52.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device comprising:

a transfer portion that transfers a toner image formed with a toner containing flat pigment particles to a recording medium;

a DC voltage applying portion that applies a DC voltage to the transfer portion;

an AC voltage applying portion that applies an AC voltage to the transfer portion; and a switching portion that switches the DC voltage applying portion and the AC voltage applying portion between a superimpose mode, in which both the DC voltage applying portion and the AC voltage applying portion are operated, and a direct-current mode, in which the DC voltage applying portion is operated and the AC voltage applying portion is not operated, when the toner image formed with the toner containing the flat pigment particles is transferred to the recycling medium in the transfer portion, the superimpose mode being applied when the flat pigment particles are transferred, and the direct-current mode being applied when the flat pigment particles are not applied.

2. An image forming apparatus comprising:

a first image portion that forms the toner image with ache toner containing flat pigment particles;

a first transfer portion that transfers the toner image formed in the first image portion to a rotating intermediate transfer belt; and the transfer device according to claim 1, the transfer device transferring the toner image transferred to the intermediate transfer belt by the first transfer portion to a recording medium.

3. The image forming apparatus according to claim 2, comprising:

a second image portion that forms a toner image with a toner that does not contain flat pigment particles;

a second transfer portion that transfers the toner image formed in the second image portion to the intermediate transfer belt; and a controller that makes a transfer voltage for transferring the toner image to the intermediate transfer belt by the first transfer portion lower than a transfer voltage for transferring the toner image to the intermediate transfer belt by the second transfer portion.

4. An image forming apparatus comprising:

a first image portion that forms the toner image with the toner containing flat pigment particles;

a second image portion that forms a toner image with a toner that does not contain flat pigment particles;

the transfer device according to claim 1, the transfer device transferring at least one of the toner image formed in the first image portion and the toner image formed in the second image portion to a recording medium; and a controller that controls the first image portion, the second image portion, and a transport portion for transporting the recording medium, such that the toner image formed by the second image portion is transferred by the transfer device to a surface of the recording medium to which the toner image formed by the first image portion has already been transferred by the transfer device.

5. A transfer method comprising:

applying a superimposed voltage, which is obtained by superimposing an AC voltage on a DC voltage in a superimpose mode, to a transfer portion when a toner image formed with a toner containing flat pigment particles is transferred to a recording medium by the transfer portion, and switching between the superimpose mode, and applying the DC voltage applying without applying the AC voltage in a direct-current mode, the superimpose mode being applied when the flat pigment particles are transferred, and the direct-current mode being applied when the flat pigment particles are not applied.

6. An image forming apparatus comprising:

a first image portion that forms a toner image with a toner containing flat pigment particles;

a first transfer portion that transfers the toner image formed in the first image portion to a rotating intermediate transfer belt; and a transfer device comprising:

a transfer portion that transfers a toner image formed with a toner containing flat pigment particles to a recording medium;

a DC voltage applying portion that applies a DC voltage to the transfer portion; and an AC voltage applying portion that applies an AC voltage to the transfer portion, the transfer device transferring the toner image transferred to the intermediate transfer belt by the first transfer portion to a recording medium a second image portion that forms a toner image with a toner that does not contain flat pigment particles;

a second transfer portion that transfers the toner image formed in the second image portion to the intermediate transfer belt; and a controller that makes a transfer voltage for transferring the toner image to the intermediate transfer belt by the first transfer portion lower than a transfer voltage for transferring the toner image to the intermediate transfer belt by the second transfer portion.

* * * * *